US006439960B1

(12) United States Patent
Fildan et al.

(10) Patent No.: US 6,439,960 B1
(45) **Date of Patent: *Aug. 27, 2002**

(54) UNDERWIRE BRASSIERE AND CUP ASSEMBLY

(75) Inventors: Gerhard Fildan, Vienna; Karl Wanzenböck, Leobersdorf, both of (AT)

(73) Assignee: Fildan Accessories Corporation, Humble, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/967,554

(22) Filed: Sep. 28, 2001

(51) Int. Cl.[7] ..... A41C 3/00
(52) U.S. Cl. ..... 450/41; 450/42
(58) Field of Search ..... 450/41, 42, 46, 450/47, 49, 51, 52; 2/255, 259, 260, 264

(56) References Cited

U.S. PATENT DOCUMENTS

| | | | | | |
|---|---|---|---|---|---|
| 2,605,468 | A | * | 8/1952 | Kramer | 450/41 |
| 2,613,365 | A | * | 10/1952 | Fairbanks et al. | 450/41 |
| 3,209,756 | A | * | 10/1965 | Rowell | 450/41 |
| 4,245,644 | A | * | 1/1981 | Evans | 450/41 |
| 5,730,641 | A | * | 3/1998 | Brown | 450/41 |
| 5,749,767 | A | * | 5/1998 | Arceo | 450/41 |

* cited by examiner

*Primary Examiner*—Gloria M. Hale
(74) *Attorney, Agent, or Firm*—Herbert Dubno

(57) ABSTRACT

A swivel wing underwire for a brassiere is received in a pocket permitting the swivel action to enable the underwire to adjust to breasts of different sizes. The tail of the underwire, however, is held in place with a cup by rows of stitching.

8 Claims, 4 Drawing Sheets

FIG. 4
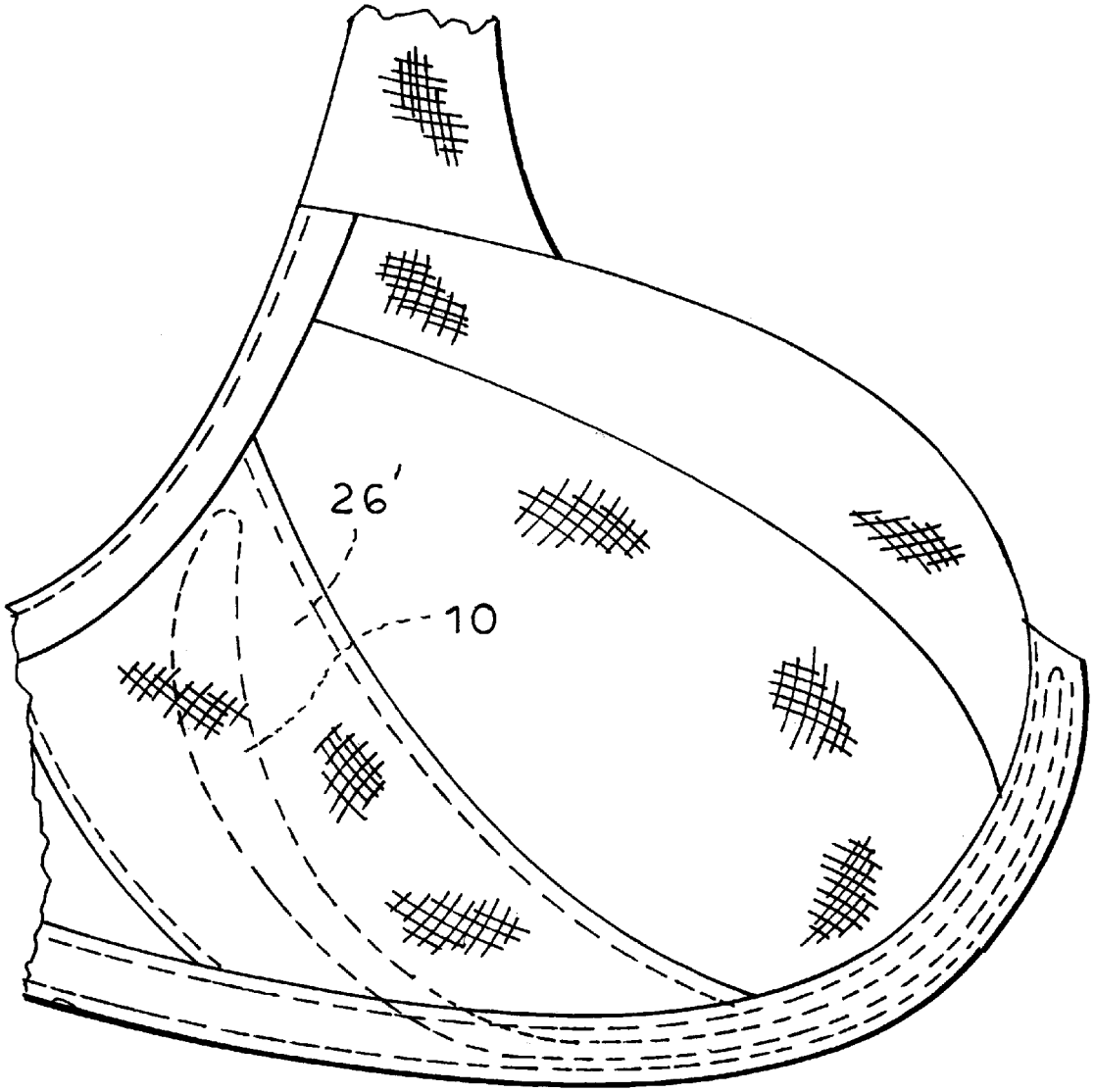
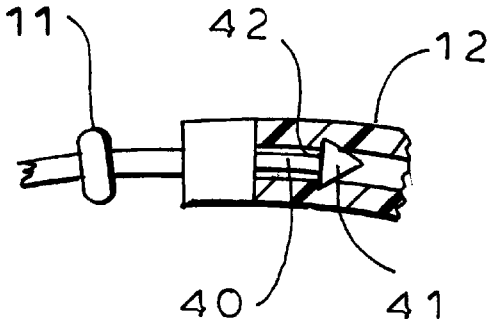
FIG. 5

UNDERWIRE BRASSIERE AND CUP ASSEMBLY

FIELD OF THE INVENTION

Our present invention relates to an underwire brassiere and cup arrangement and, more particularly, to a brassiere construction utilizing an underwire having a swivelable portion lying alongside the breast.

BACKGROUND OF THE INVENTION

Underwire brassieres are well known and generally comprise a separate underwire received in a channel formed by stitching below each cup of the brassiere, or a single underwire frame with respective portions received in such channels beneath each cup and connected at a bridge piece between the underwire segments where the cups are joined together at the mid portion of the front of the brassiere. The underwires may be relatively flexible to assume the shape imparted to them by the channel while nevertheless providing support beneath the breast. They also can be comparatively stiff so that the shape of the channel after the underwire has been stitched into the brassiere, is the shape of the portion of the brassiere pressing against the chest of the wearer.

In our copending application ser. No. 09/837,869, filed Apr. 10, 2001, we have described an underwire having a swiveling portion or wing which can be generally of spoon shape and which is intended to rest against the side of the breast to adjust automatically in its angular position with respect to an arcuate tail, to the contour of the body at the junction of the breast with the remainder of the chest.

OBJECTS OF THE INVENTION

It is the main object of the present invention to extend the principles of that copending application and provide an improved brassiere and cup structure which can maximize the advantages of the swivelable underwire.

Another object of this invention is to provide a brassiere structure which eliminates drawbacks of earlier brassiere structures.

SUMMARY OF THE INVENTION

These objects are obtained, in accordance with the invention in a brassiere which comprises:

a pair of brassiere cups;

straps connected to the brassiere cups and enabling the brassiere to be supported on a torso of a wearer whose breasts are received in the cups, each of the cups having a pocket lying along an outer side of a respective breast and extending into a respective channel narrower than the respective pocket and extending along a lower edge of a respective cup and upwardly along an inner side of the respective breast; and a respective underwire received in the pocket and the channel and having a generally spoon-shaped wing received in the respective pocket and an arcuate tail extending along the respective channel, the wing being swivelably connected to the respective tail.

More particularly, we have found that an underwire having a generally spoon shaped or broad swivelable end portion referred to also as a wing herein and an arcuate tail portion connected to the broad end portion at a swivel joint is best received in a pocket formed by a piece of fabric affixed to the cup-forming fabric and stitched along the tail portion of the underwire while leaving the broad portion free to swivel within the pocket. Not only does the underwire thus accommodate itself to the actual shape of the breast at its junction with the sternum or chest of the wearer, but the pocket, when attached to the cup fabric in the manner described, forms a substantially inextensible harness or sling for the underwire which draws the free end of the tail thereof toward the free end or tip of the broad portion.

The result is a more comfortable fit and accommodation of the brassiere to the breast while providing the full support of the underwire.

According to a feature of the invention, the pocket fabric is stitched along the underside of the cup fabric and that a location across the cup well above the side portion of the underwire to allow free swivelling of the latter. The pocket fabric can be provided on the exterior or interior of the cup fabric as desired and the free portion of the pocket can be provided on either side of the breast.

According to a feature of the invention, the pocket of each cup is formed by a respective strip of a tricot fabric stitched to the fabric of the cup at least along two opposite edges of the strip. The strip is substantially inextensible and retains the underwire against opening (spreading) when a breast is received in the respective cup. Advantageously rows of stitching flank the tail of each underwire substantially along the full length thereof from a free end of the tail to the respective wing or spoon. A row of stitching can pass through the strip along the tail.

BRIEF DESCRIPTION OF THE DRAWING

The above and other objects, features, and advantages will become more readily apparent from the following description, reference being made to the accompanying drawing in which:

FIGS. 3 and 4 are illustrations diagrammatically showing different configurations of the pocket forming strips; and FIG. 5 is a detail of the swivel.

SPECIFIC DESCRIPTION

Figure 2:
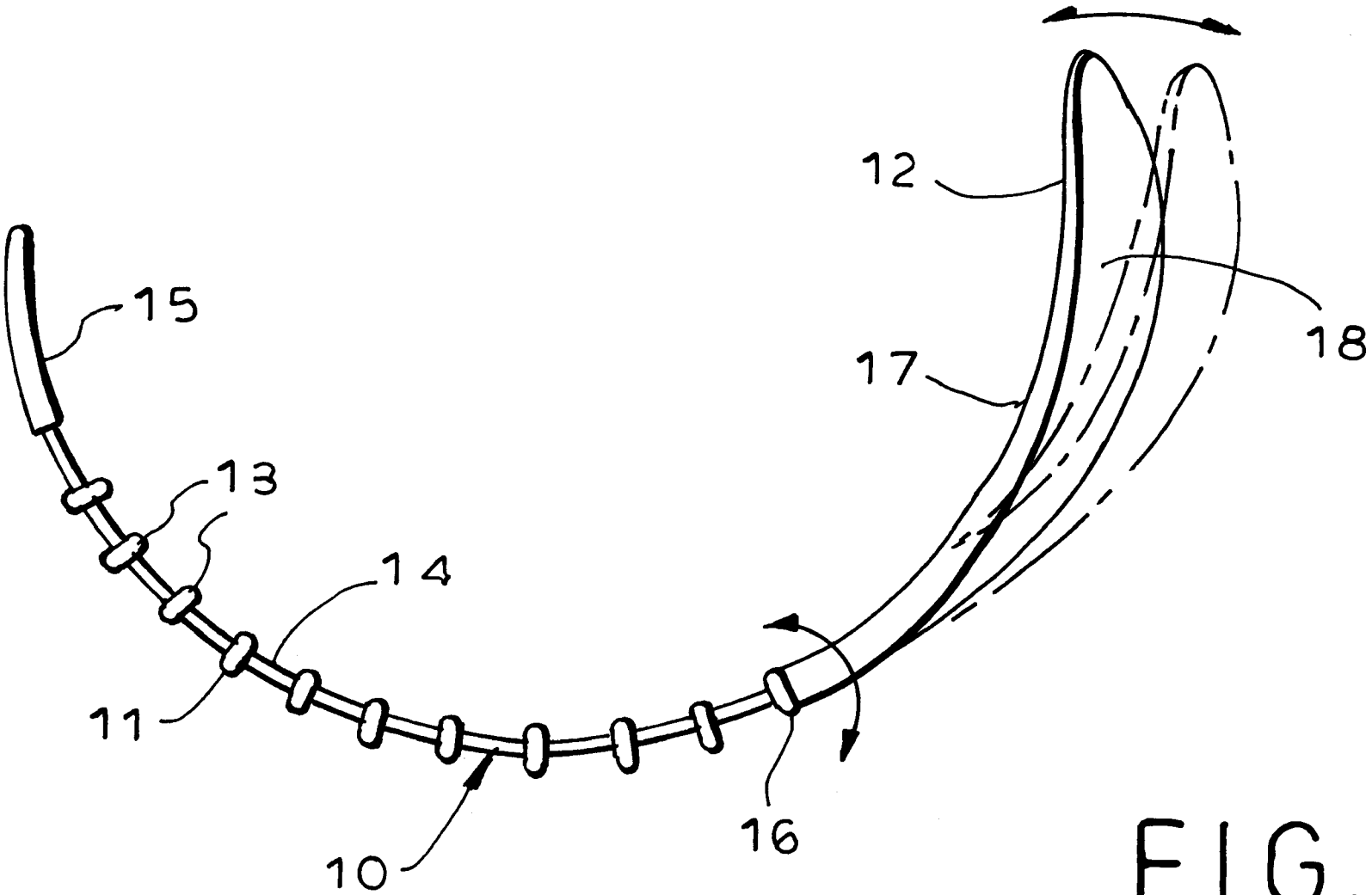
FIG. 2 is a perspective view of an underwire spoon out of the pocket.

The present invention is an improvement on the wing-shaped or swiveling spoon underwire disclosed in our copending U.S. application Ser. No. 09/837,869 filed Apr. 18, 2001. The three-dimensional underwire 10 there disclosed comprises (see FIG. 2) a tail 11 which is arcuate and lies in a single plane, such as the plane of the paper of FIG. 2, and a swiveling spoon or wing 12. The tail 11 may be formed with ribs 13 along a spine 14 of smaller diameter than the ribs and can have a tapered free end 15 opposite an end 16 formed with a plug and socket connection to the wing or spoon 12. The latter widens away from the plug and socket connection 16 and is double curved with a convex side 17 and a concave side 18. The convex side 17 is shaped to nestle around the base of the breast at its junction with the chest at the outer side of the breast.

Figure 1:
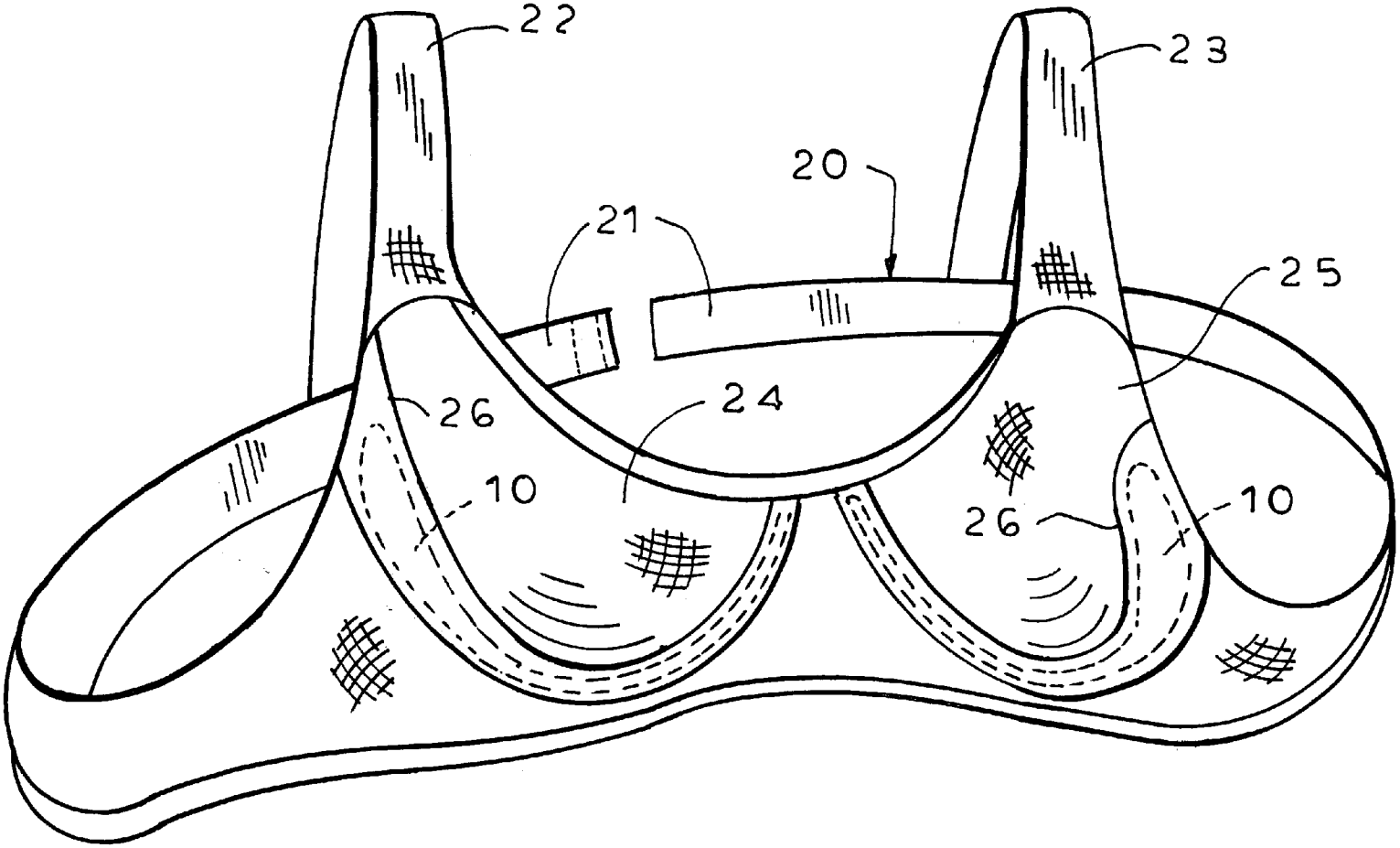
FIG. 1 is a diagrammatic perspective view of a brassiere provided with the pockets and spoon-shaped underwires of the present invention.

The swiveling action allows the spring or tongue to adjust to breasts of different size automatically. As can be seen from FIG. 1, a brassiere 20 may have a back strap 21, shoulder straps 22 and 23 and a pair of cups 24 and 25 each of which is formed internally or externally with a strip 26 of a tricot fabric forming a pocket receiving the respective underwire 10 and enabling the spoon or wing 12 thereof to swivel. Because the strip 26 is substantially inextensible, the underwire cannot open or spread, although the swiveling action allows the spoon to lie snugly against the breast regardless of the size of the breast and without requiring different sizes of underwire for different cup sizes. Of course, the underwires are mirror symmetrical with one another for the two cups.

Figure 3:
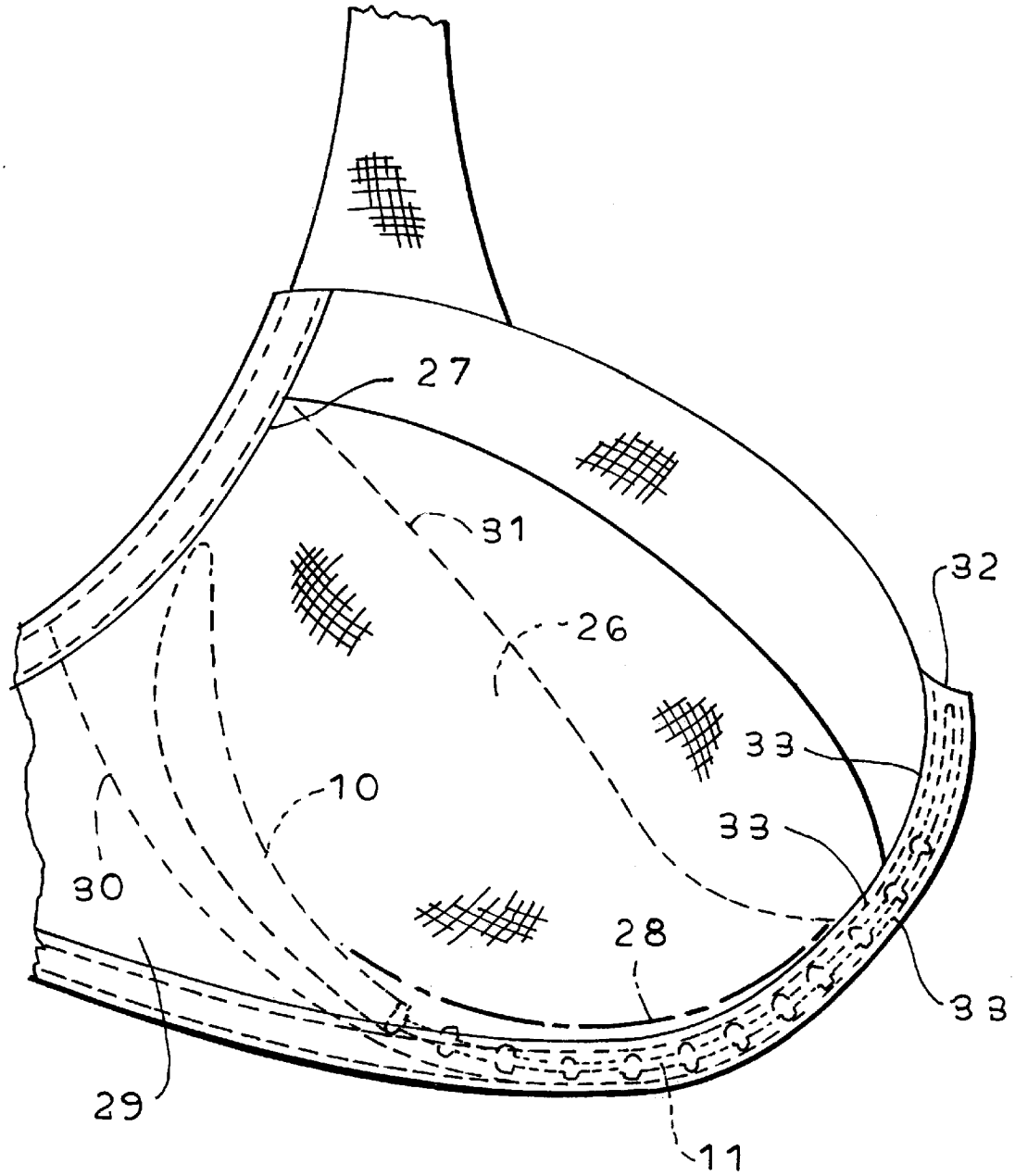

As will be apparent from FIGS. 3 and 4, the tricot strip 26 can be stitched at 27 and 28 to the fabric 29 of the cup and along opposite edges of the pocket. Stitching can also be provided along longitudinal edges 30 and 31 if desired. The tail 11 of the wire 10 can be retained between rows of stitches 33 securing a channel band 32 along the inner and lower edges of the cup. In the embodiment shown in FIG. 3, the strip 26 extends over the apex of the cup whereas, in FIG. 4, the strip 26' lies below the apex of the cup. The socket between the wing portion 12 and the tail portion 11 of the underwire may be formed as a barb 40 engaging in a socket 4 of the wing past a shoulder 42.

We claim:

1. A brassiere comprising:

a pair of brassiere cups;

straps connected to said brassiere cups and enabling said brassiere to be supported on a torso of a wearer whose breasts are received in said cups, each of said cups having a pocket lying along an outer side of a respective breast and extending into a respective channel narrower than the respective pocket and extending along a lower edge of a respective cup and upwardly along an inner side of the respective breast; and a respective underwire received in said pocket and said channel and having a generally spoon-shaped wing received in the respective pocket and an arcuate tail extending along the respective channel, the wing being swivelably connected to the respective tail.

2. The brassiere defined in claim 1 wherein said pocket is formed by a strip of a tricot fabric stitched to fabric of said cup at least along two opposite edges of said strip.

3. The brassiere defined in claim 2 wherein said strip is substantially inextensible and retains said underwire against opening when a breast is received in the respective cup.

4. The brassiere defined in claim 3, further comprising rows of stitching flanking said tail substantially along a length thereof from a free end of said tail to said wing.

5. The brassiere defined in claim 4 wherein a row of stitching extends through said strip along said tail.

6. The brassiere defined in claim 5 wherein each underwire has a plug-and-socket connection joining the respective wing swivelably with the respective tail.

7. The brassiere defined in claim 5 wherein the respective strip is located along an outer surface of the respective cup.

8. The brassiere defined in claim 4 wherein said strip is located along an internal surface of the respective cup.

* * * * *